US009505117B2

(12) United States Patent
Chen

(10) Patent No.: US 9,505,117 B2
(45) Date of Patent: Nov. 29, 2016

(54) CLAW HAMMER WITH AN ANGLE-ADJUSTABLE CLAW

(71) Applicant: LUCKY-BRAND INDUSTRIAL CO., LTD, Taichung (TW)

(72) Inventor: Ying-Chieh Chen, Taichung (TW)

(73) Assignee: LUCKY-BRAND INDUSTRIAL CO., LTD, Taichung (TW)

( * ) Notice: Subject to any disclaimer, the term of this patent is extended or adjusted under 35 U.S.C. 154(b) by 360 days.

(21) Appl. No.: 14/016,474

(22) Filed: Sep. 3, 2013

(65) Prior Publication Data

US 2015/0008380 A1 Jan. 8, 2015

(30) Foreign Application Priority Data

Jul. 5, 2013 (TW) ..... 102124270 A

(51) Int. Cl.
*B25D 1/00* (2006.01)
*B25D 1/04* (2006.01)

(52) U.S. Cl.
CPC ..... *B25D 1/045* (2013.01); *B25D 2250/005* (2013.01); *B25D 2250/011* (2013.01); *B25D 2250/371* (2013.01)

(58) Field of Classification Search
CPC ..... B25B 1/00; B25B 1/02; B25B 1/04; B25B 1/045; B25B 1/08; B25B 2250/011; B25B 2250/371; B25C 3/00; B25G 1/06
USPC ..... 254/26 R; 81/20, 177.8, 177.9; 7/145
See application file for complete search history.

(56) References Cited

U.S. PATENT DOCUMENTS 441,879 A * 12/1890 Lindley ..... B25D 1/00 254/26 R
661,717 A * 11/1900 Hawes ..... B25D 1/04 254/26 R
1,615,169 A * 1/1927 Ellis ..... B25B 13/08 81/177.8
2,804,109 A * 8/1957 Fatica ..... B26B 23/00 172/372
3,000,414 A * 9/1961 Cordis ..... B25D 1/02 81/22
4,183,385 A * 1/1980 Burkybile ..... B25D 1/02 30/308.3
5,115,536 A * 5/1992 Jarvis ..... B25G 3/38 15/144.1
5,216,939 A * 6/1993 Swenson ..... B25D 1/02 81/20
5,255,575 A * 10/1993 Williams ..... B25D 1/02 81/25
5,280,738 A * 1/1994 Liou ..... B25D 1/00 81/177.8
6,016,722 A * 1/2000 Gierer ..... B25D 1/12 81/20
6,128,977 A * 10/2000 Gierer ..... B25D 1/12 7/144
6,289,540 B1 * 9/2001 Emonds ..... A01B 1/022 15/141.1
8,201,806 B2 * 6/2012 Liou ..... B25D 1/00 254/26 R
8,424,845 B2 * 4/2013 Cole ..... B25D 1/045 254/22

* cited by examiner

*Primary Examiner* — David Bryant
*Assistant Examiner* — J Stephen Taylor
(74) *Attorney, Agent, or Firm* — Muncy, Geissler, Olds & Lowe, P.C.

(57) ABSTRACT

A claw hammer includes a handle having a handle head, a claw pivotally mounted at the handle head of the handle, and a hammer head mounted at the handle head and movable relative to the handle head between a locking position where the hammer head and the claw are engaged together to lock the claw to the handle head and an unlocking position where the hammer head and the claw are disengaged from each other for allowing the claw to be rotatable relative to the handle head to the desired operating angle.

5 Claims, 15 Drawing Sheets

CLAW HAMMER WITH AN ANGLE-ADJUSTABLE CLAW

BACKGROUND OF THE INVENTION

1. Field of the Invention

The present invention relates to nail pounding and extracting tools, and more particularly to a claw hammer that allows adjustment of the angular position of the claw.

2. Description of the Related Art

A claw hammer generally comprises a hammer head at one side for pounding nails into an object, and a claw at an opposite side for extracting nails from an object by means of the lever principle by stopping the hammer head against the object.

However, the claw of a conventional claw hammer is formed integral with the hammer head. The operating angle of the claw is not adjustable. When using a conventional claw hammer to extract nails, the operating environment must have sufficient space for accommodating the hammer head and for allowing operation of the handle. In consequence, it can be difficult or impossible to use a conventional claw hammer in some conditions (narrow place or any other place where there is an obstacle). This will cause inconvenience to the user.

SUMMARY OF THE INVENTION

The present invention has been accomplished under the circumstances in view. It is the main object of the present invention to provide a claw hammer, which allows the user to adjust the claw to the desired operating angle to fit different application requirements.

To achieve this and other objects of the present invention, a claw hammer of the invention comprises a handle, a claw, and a hammer head. The handle comprises a handle body and a handle head. The handle head is fixedly mounted at the top end of the handle body. The claw is pivotally mounted at the handle head of the handle. The hammer head is mounted at the handle head, and movable relative to the handle head between a locking position and an unlocking position. When the hammer head is moved to the locking position, the hammer head and the claw are engaged together to lock the claw to the handle. When the hammer head is moved to the unlocking position, the hammer head and the claw are disengaged from each other, allowing the claw to be biased relative to the handle set to the desired angular position. Thus, by means of moving the hammer head to the unlocking position, the claw can then be adjusted to a suitable operating angle to fit the application environment. After adjustment of the angular position of the claw, the hammer head is moved to the locking position to lock the claw in the adjusted position.

Preferably, the handle head of the handle comprises an axial hole; the claw comprises a pivot connection, and a plurality of first positioning portions arranged is around the periphery of the pivot connection; the hammer head comprises a positioning shaft axially movably mounted in the axial hole. Further, the positioning shaft comprises a second positioning portion. When the hammer head is moved to the locking position, the second positioning portion of the positioning shaft is selectively engaged into one of the first positioning portions of the claw. When the hammer head is moved to the unlocking position, the second positioning portion of the positioning shaft is disengaged from the first positioning portions of the claw.

Preferably, the hammer head further comprises a circlip and an elastic restoring component. The positioning shaft comprises a flange. The circlip is mounted around the positioning shaft and affixed to the inside of the axial hole. The elastic restoring component is sleeved onto the positioning shaft and stopped between the flange of the positioning shaft and the circlip. Thus, when applying a pulling force to the hammer head to carry the second position portion of the positioning shaft away from the first positioning portion of the claw. Once the hammer head is released from the user's hand, the positioning shaft is immediately forced back by the elastic potential energy of the elastic restoring component to move the second positioning portion into engagement with one first positioning portion of the claw.

Preferably, the axial hole of the handle comprises an internally threaded segment; the positioning shaft comprises an externally threaded segment. The externally threaded segment of the positioning shaft is threaded into the internally threaded segment of the axial hole. Thus, by means of loosening or fastening tight the hammer head, the second positioning portion of the positioning shaft is disengaged from or forced into engagement with the first positioning portion of the claw.

Preferably, the handle head of the handle comprises a clamping protrusion. Further, the claw comprises a nail-pulling portion. The clamping protrusion of the handle head and the nail-pulling portion of the claw define a clamping gap therebetween. The size of the clamping gap is changeable subject to change of the operating angle of the claw.

Other advantages and features of the present invention will be fully understood by reference to the following specification in conjunction with the accompanying drawings, in which like reference signs denote like components of structure.

DETAILED DESCRIPTION OF THE INVENTION

Figure 1:
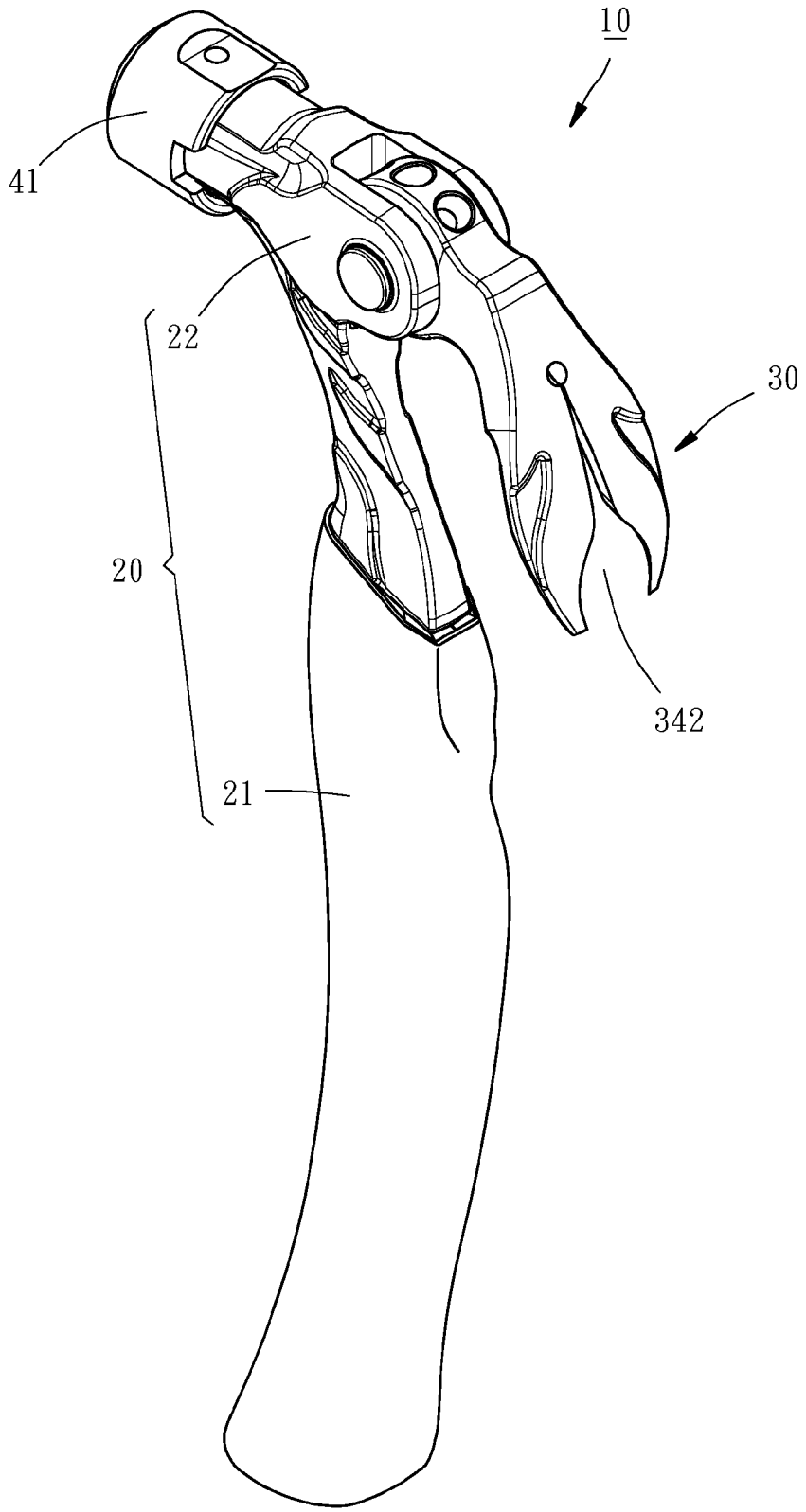
FIG. 1 is an elevational view of a claw hammer in accordance with a first embodiment of the present invention.
Figure 2:
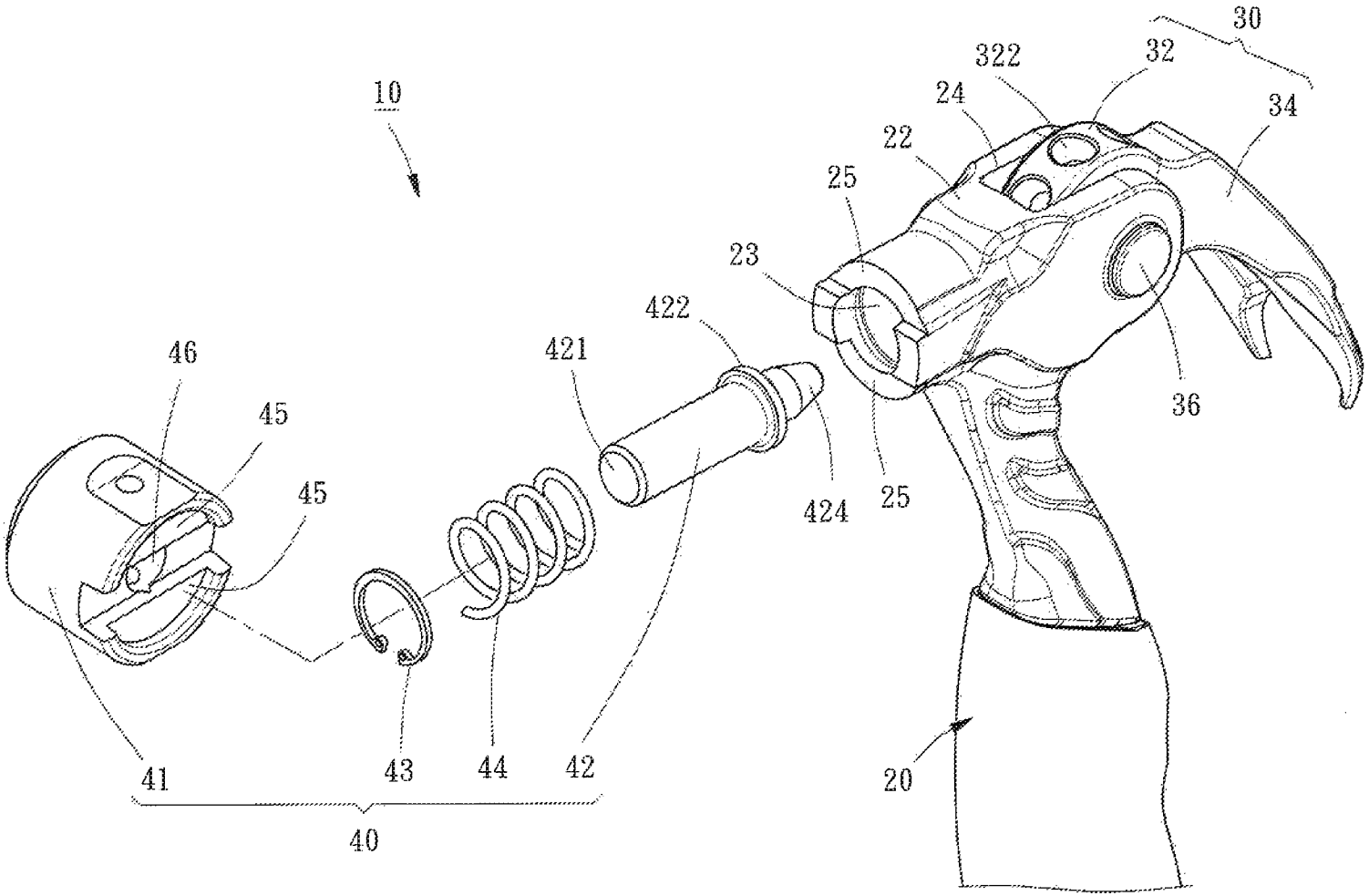
FIG. 2 is an exploded view of a part of the claw hammer in accordance with the first embodiment of the present invention.

Referring to FIGS. 1 and 2, a claw hammer 10 in accordance with a first embodiment of the present invention is shown. The claw hammer 10 comprises a handle 20, a claw 30, and a head 40.

The handle 20 comprises a handle body 21 and a handle head 22. The handle body 21 is configured so as to enable the handle 20 to be grasped by a human hand. The handle head 22 is fixedly located at a top end of the handle body 21. The handle head 22 comprises two first planar abutment surface portions 25 (actually, one first planar abutment surface portion is sufficient to achieve the desired effect, however, two first planar abutment surface portions are better) located at a front end thereof at two opposite sides, a mounting slot 24 located at an opposing rear end thereof, an axial hole 23 having its one end, namely, the front end disposed between the two first planar abutment surface portions 25 and its other end, namely, the rear end disposed in communication with the mounting slot 24. Further, the axial hole 23 is a stepped hole, defining therein a stepped portion 232 (see FIG. 3).

The claw 30 comprises a pivot connection 32 and a nail-pulling portion 34. The pivot connection 32 is accommodated in the mounting slot 24 of the handle head 22 of the handle 20 and pivotally connected to the handle head 22 of the handle 20 with a pivot 36, enabling the claw 30 to be biased relative to the handle 20 between a locking position P1 (see FIG. 4B) and a unlocking position P2 (see FIG. 4A). The claw 30 further comprises a plurality of first positioning portions 322 located at the pivot connection 32 and arranged in a curved line around the pivot 36. Further, every first positioning portion 322 can be a retaining hole or retaining block. In this embodiment, the first positioning portions 322 are retaining holes. The nail-pulling portion 34 is integrally extended from the pivot connection 32, defining a nail-pulling notch 342 for engagement with the nail (not shown) to be pulled.

Figure 3:
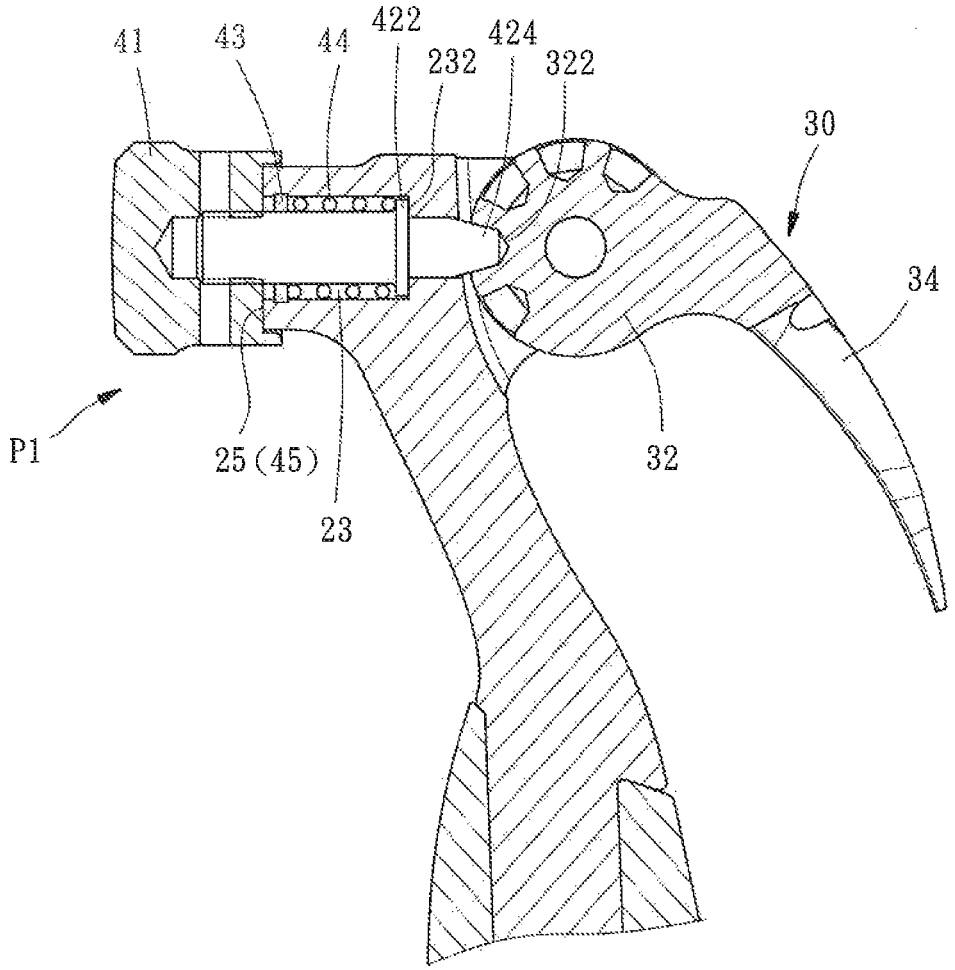
FIG. 3 is a sectional view of a part of the claw hammer in accordance with the first embodiment of the present invention.

The hammer head 40 comprises a bell 41, a positioning shaft 42, a circlip (snap ring) 43, and an elastic restoring component 44. As illustrated in FIG. 3, the hammer head 40 has a rear end thereof connected to the front end of the handle head 22 of the handle 20. Further, the bell 41 comprises two second planar abutment surface portions 45 (actually, one first planar abutment surface portion is sufficient to achieve the desired effect, however, two first planar abutment surface portions are better) located at the rear end thereof at two opposite sides for abutting against the two first planar abutment surface portions 25 of the handle head 22 of the handle 20 and a locating hole 46 located at the center of the rear end between the two first planar abutment surface portions 25. The positioning shaft 42 is inserted into the axial hole 23 of the handle 20, comprising opposing locating end 421 and second positioning portion 424, and a flange 422 spaced between the locating end 421 and the second positioning portion 424. The locating end 421 of the positioning shaft 42 is affixed to the locating hole 46 of the bell 41. Further, the second positioning portion 424 of the positioning shaft 42 can be a retaining hole or retaining block. In this embodiment, the second positioning portion 424 is a retaining block for fastening to one first positioning portion 322 of the claw 30. The flange 422 of the positioning shaft 42 is adapted for abutting against the stepped portion 232 in the axial hole 23. The circlip 43 is attached to the positioning shaft 42 and affixed to the inside of the axial hole 23. The elastic restoring component 44 is sleeved onto the positioning shaft 42 and stopped between the circlip 43 and the flange 422 of the positioning shaft 42.

Figure 4A:
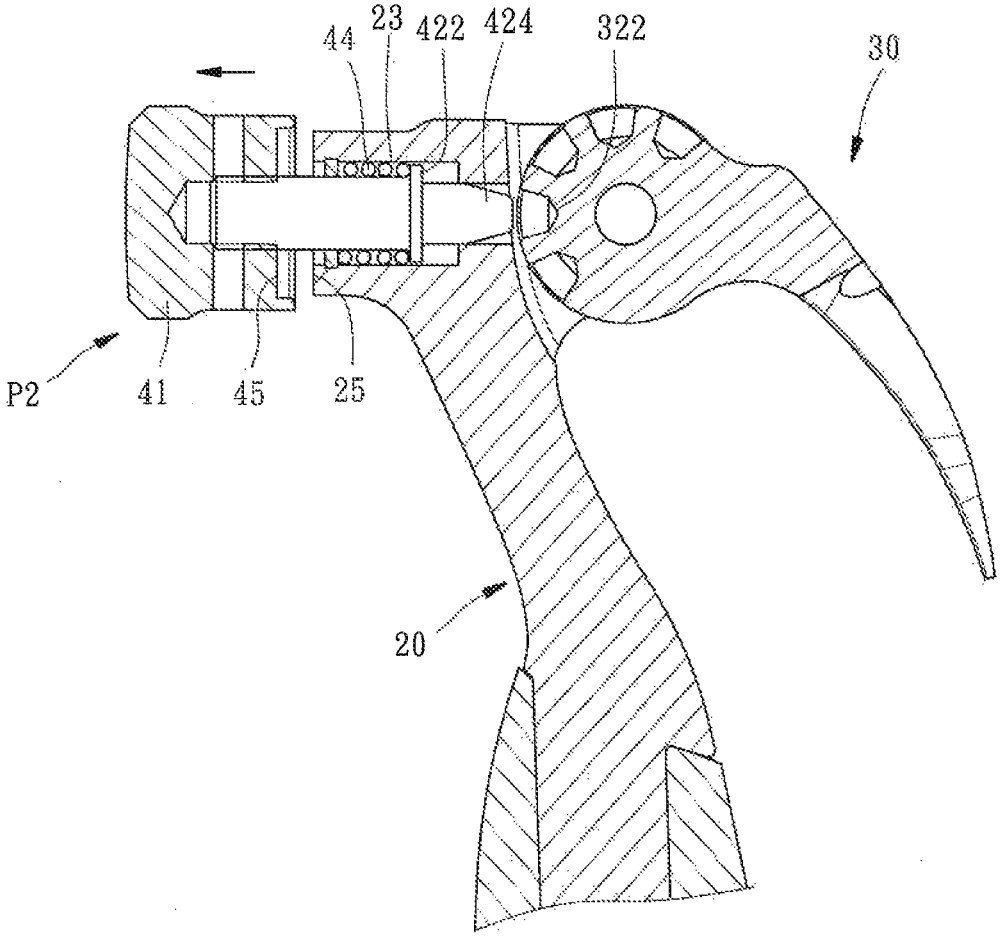
FIG. 4A and FIG. 4B are similar to FIG. 3, illustrating the adjustment of the angular position of the claw.
Figure 4B:
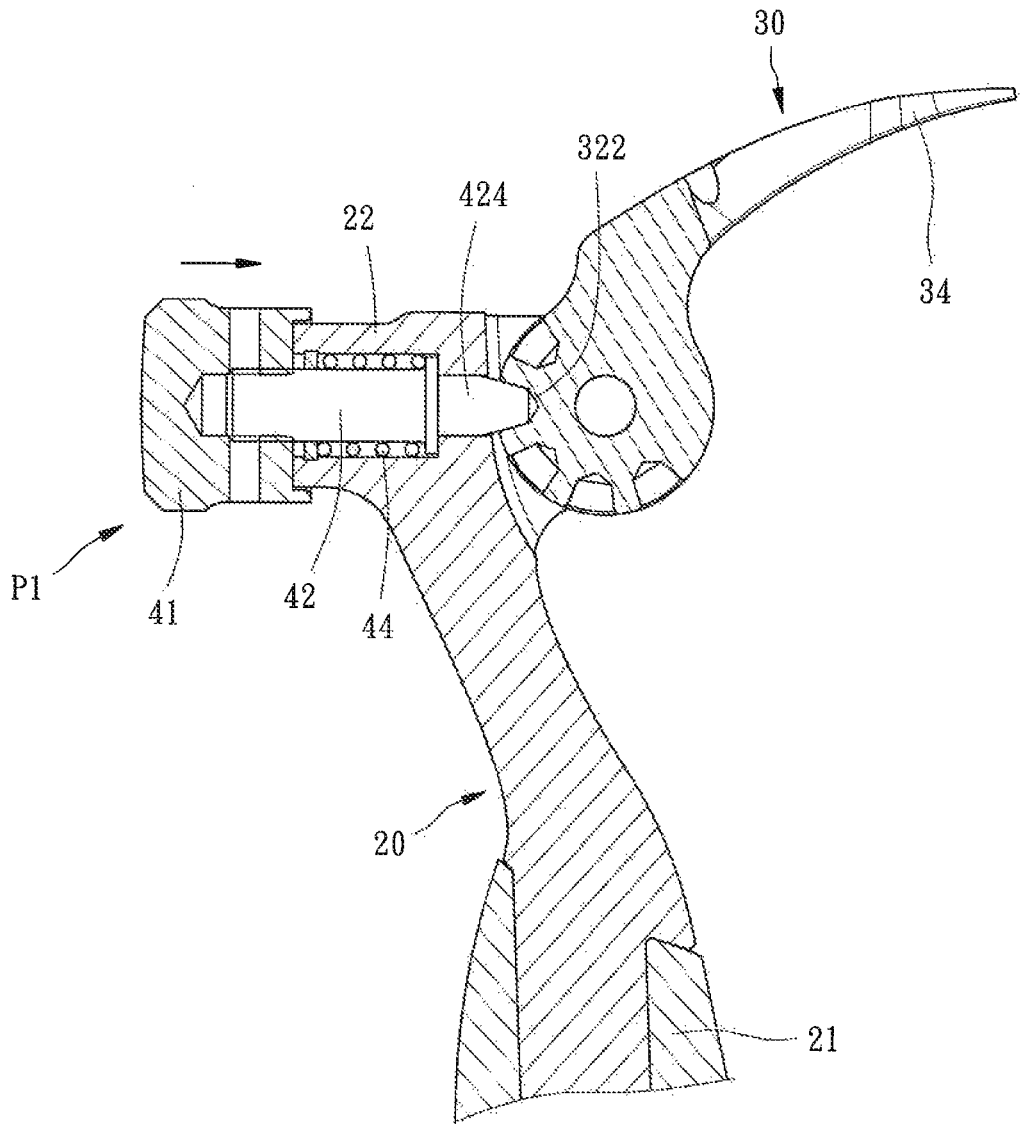

Therefore, when wing to adjust the angular position of the claw 30, pull the bell 41 to carry the positioning shaft 42 along the axis of the axial hole 23 in direction away from the handle head 22 and to shift the hammer head 40 to the unlocking position P2, as shown in FIG. 4A. At this time, the second positioning portion 424 of the positioning shaft 42 is disengaged from the first positioning portions 322 of the claw 30, the second planar abutment surfaces 45 of the bell 41 are kept apart from the first planar abutment surface portions 25 of the handle head 22 of the handle 20, and the elastic restoring component 44 is compressed by the flange 422 of the positioning shaft 42. Thus, subject to the pivot connection relationship between the claw 30 and the handle 20, the user can bias the claw 30 relative to the handle 20 to the desired operating angle at this time. After the claw 30 is adjusted to the desired operating angle, release the hand from the bell 41, enabling the positioning shaft 42 to be forced by the elastic potential energy of the elastic restoring component 44 to move along the axis of the axial hole 23 in direction toward the inside of the handle head 22 and to shift the hammer head 40 from the unlocking position P2 to the locking position P1, as shown in FIG. 4B, where the second planar abutment surfaces 45 of the bell 41 are kept abutted against the first planar abutment surface portions 25 of the handle head 22 of the handle 20, and the second positioning portion 424 of the positioning shaft 42 is engaged into one first positioning portion 322 of the claw 30 to lock the claw 30 to the handle 20 in the adjusted position. Thus, the angle of the claw 30 relative to the hammer head 40 as well as the handle 20 is changed, the direction of force applied by the user to the handle body 21 of the handle 20 and the direction of force applied through the nail-pulling portion 34 of the claw 30 are also relatively changed, i.e., the claw hammer 10 of the invention compared to the prior art designs can better meet different application needs, significantly enhancing operating convenience.

Figure 5:
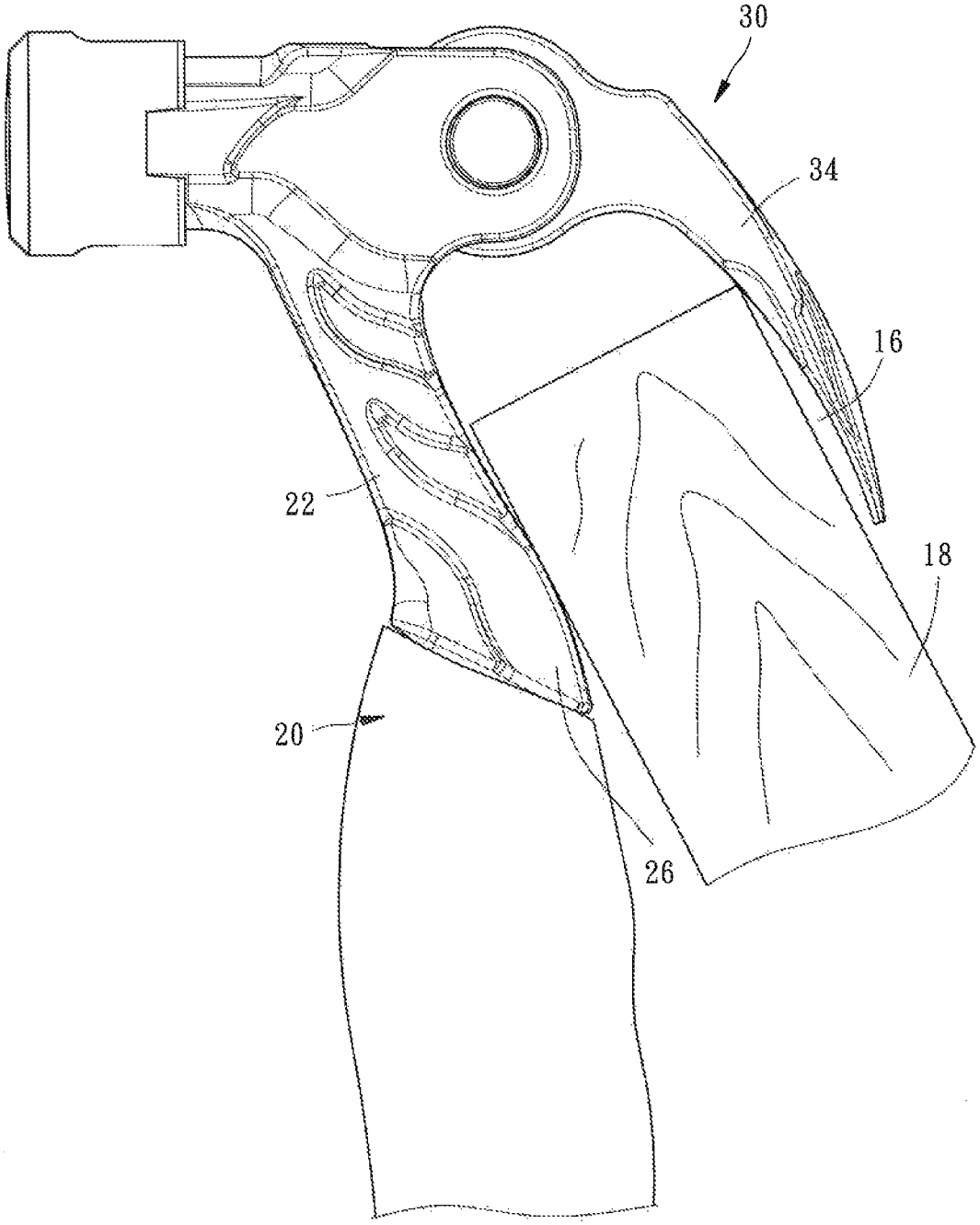
FIG. 5 is a schematic plain view of the first embodiment of the present invention, illustrating an object clamped in the clamping gap of the claw hammer.

On the other hand, as shown in FIG. 5, in addition to the feature of adjustability of the angular position of the claw 30 to fit different operating environments, the claw hammer 10 can also be used to clamp an object 18, alleviating the burden on the construction work. In order to achieve this effect, the handle head 22 of the handle 20 is configured to provide a clamping protrusion 26. The clamping protrusion 26 of the handle head 22 and a bottom wall (back wall) of the nail-pulling portion 34 of the claw 30 define therebetween a clamping gap 16. The size of the clamping gap 16 can be relatively adjusted to fit the size of the object 18 (such as wooden plate) subject to change of the operating angle of the claw 30.

Figure 6:
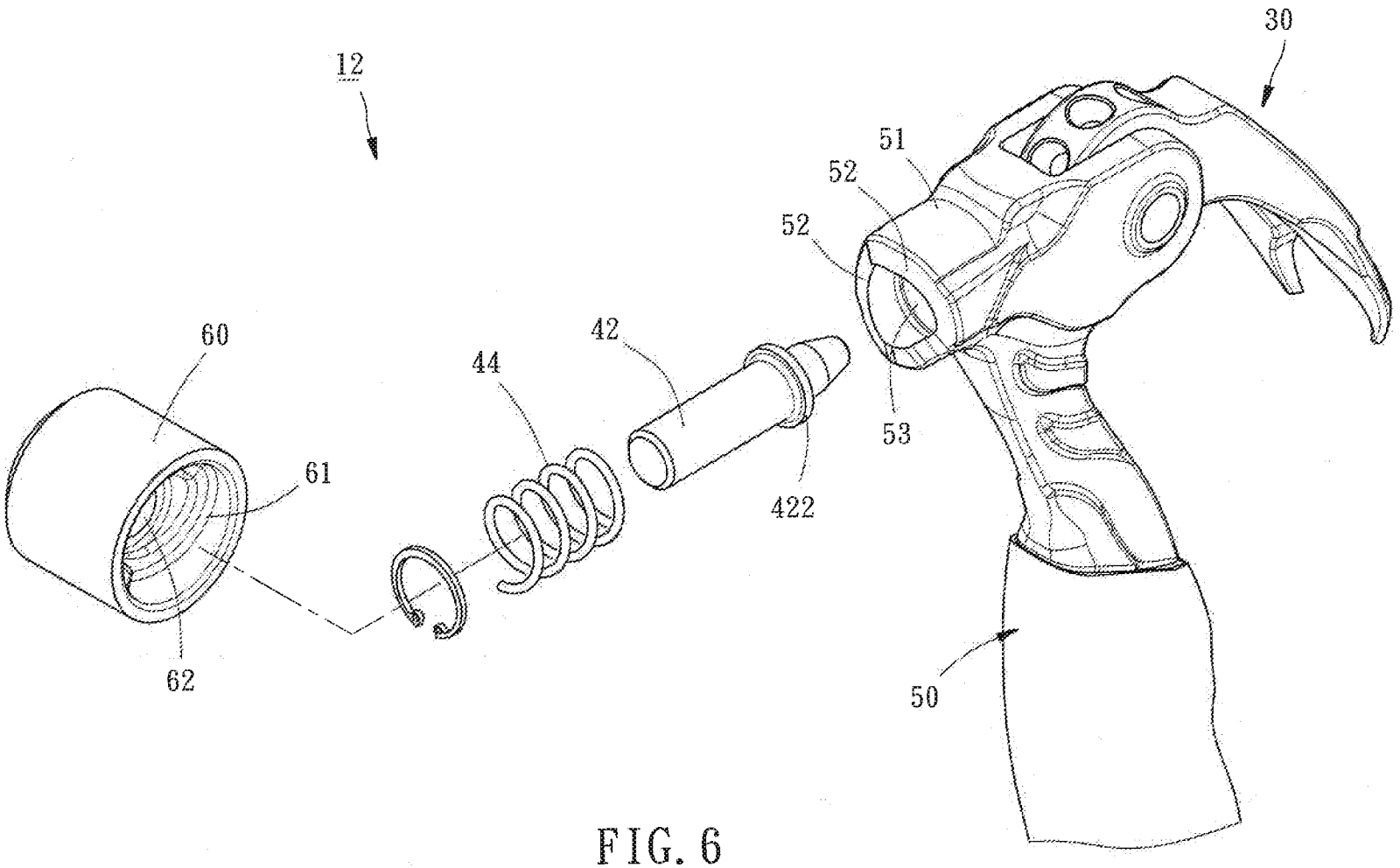
FIG. 6 is an elevational exploded view of a claw hammer in accordance with a second embodiment of the present invention.
Figure 7:
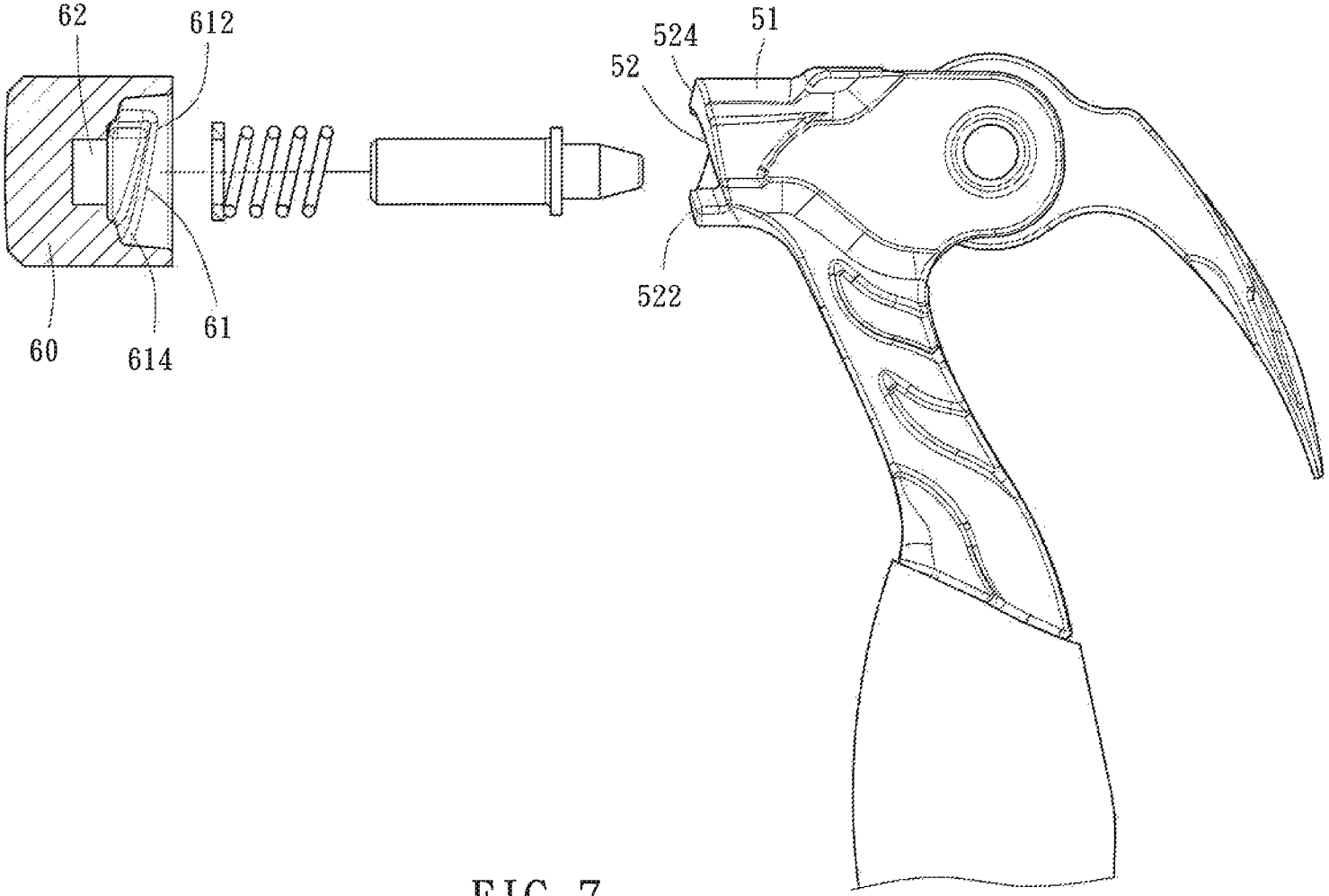
FIG. 7 is an exploded plain view of the claw hammer in accordance with the second embodiment of the present invention.
Figure 8:
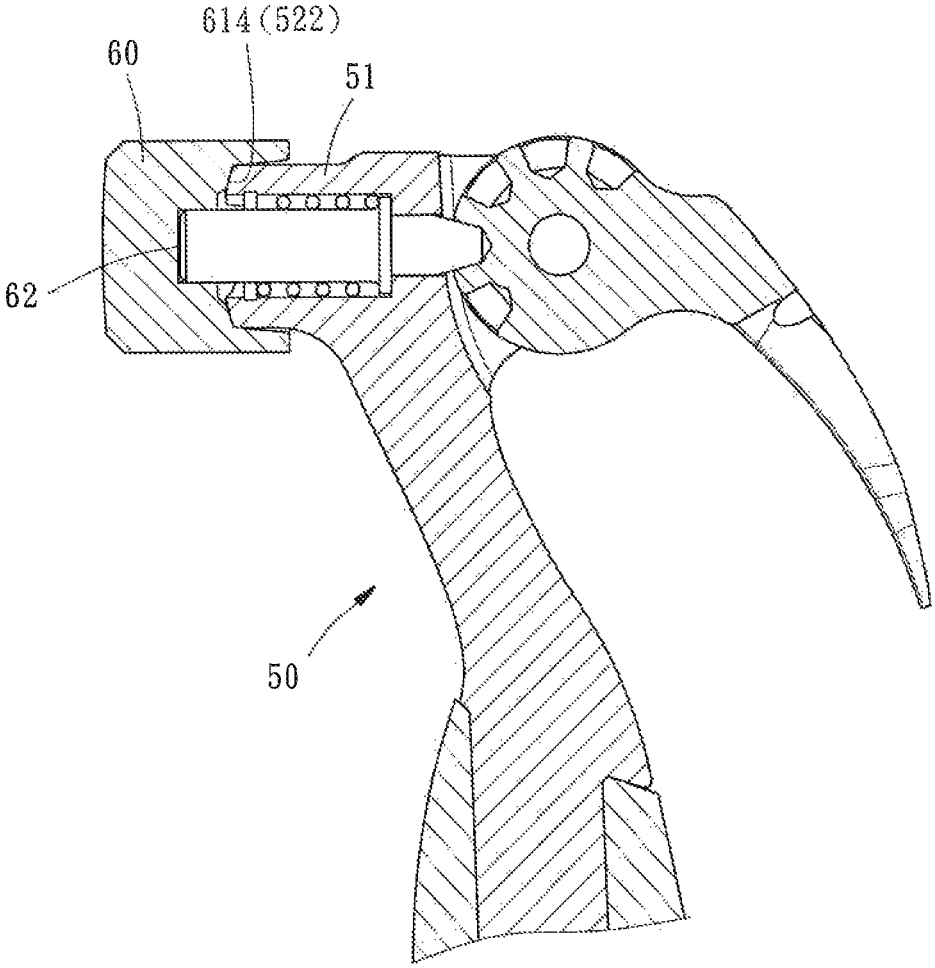
FIG. 8 is a sectional view of a part of the claw hammer in accordance with the second embodiment of the present invention.

Referring to FIGS. 6-8, a claw hammer 12 in accordance with a second embodiment of the present invention is shown. This second embodiment is substantially similar to the aforesaid first embodiment with the exception of the structure of the handle head 51 of the handle 50 and the structure of the bell 60.

According to this second embodiment, the handle head 51 of the handle 50 comprises two first beveled surfaces 52 located at the front end thereof. These two first beveled surfaces 52 extend around the axial hole 53. The bell 60 comprises two second beveled surfaces 61 located at the rear end thereof. These two second beveled surfaces 61 extend around the locating hole 62, and slope in the reversed direction relative to the sloping direction of the first beveled surfaces 52 of the handle head 51, i.e., the highest point 612 of each second beveled surface 61 of the bell 60 is abutted against the lowest point 524 of one respective first beveled surface 52 of the handle 51, and the lowest point 614 of each second beveled surface 61 of the bell 60 is abutted against the highest point 522 of one respective first beveled surface 52 of the handle head 51.

Figure 9A:
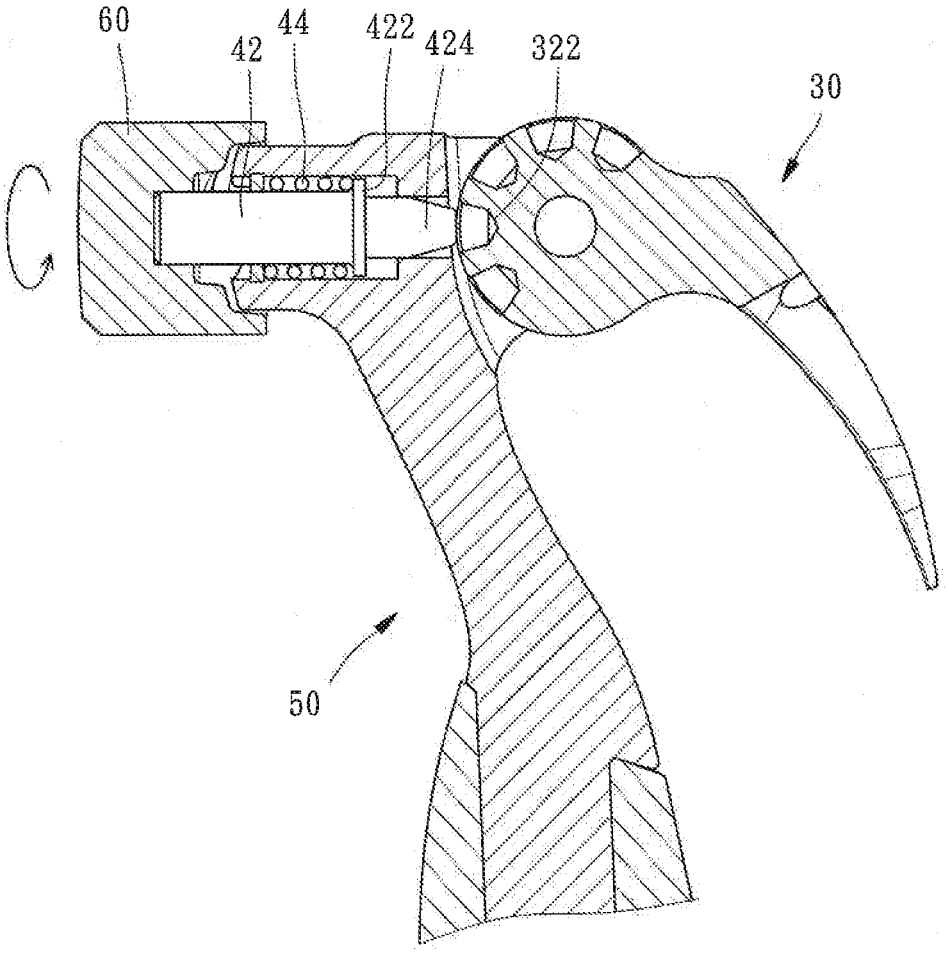
FIG. 9A and FIG. 9B are similar to FIG. 8, illustrating the adjustment of the angular position of the claw.
Figure 9B:
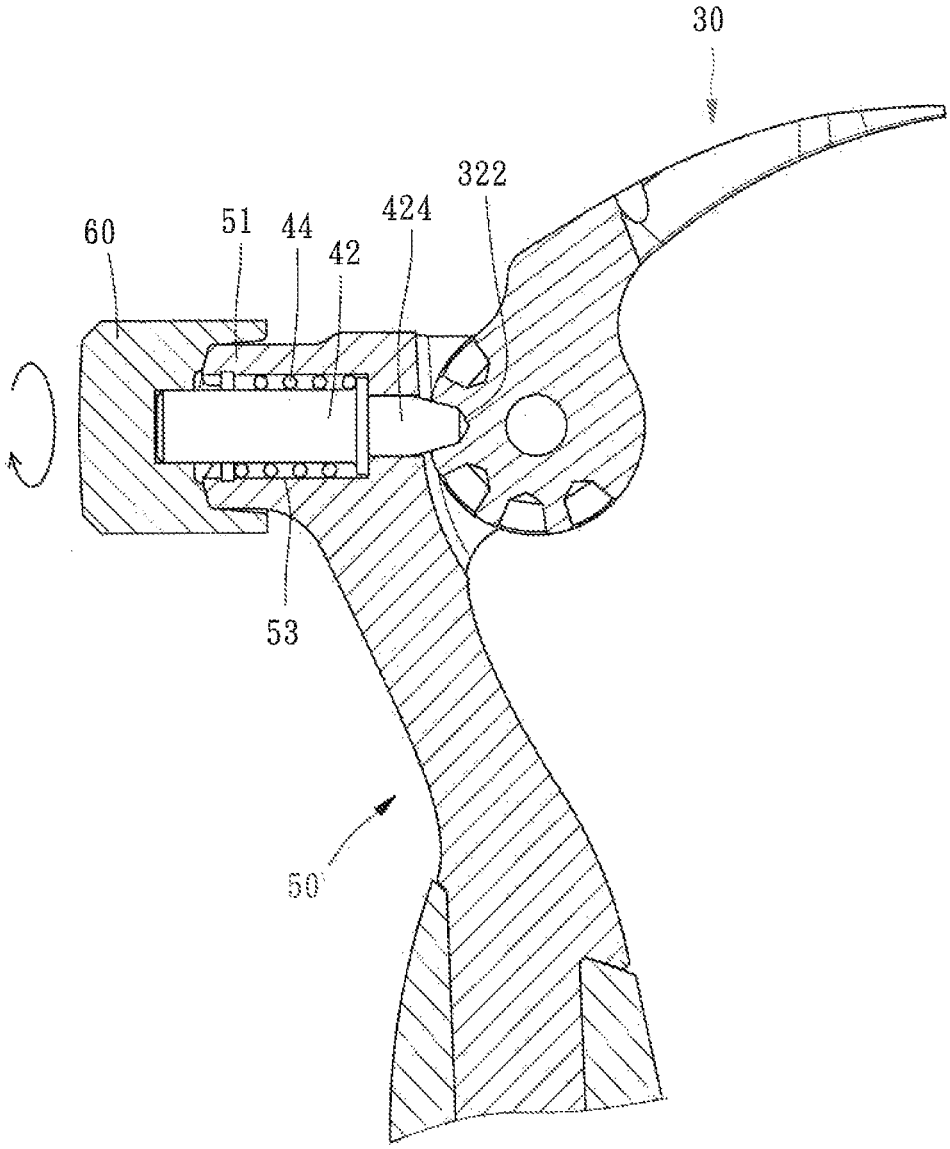

Thus, when going to adjust the angle position of the claw 30, rotate the bell 60 through a predetermined angle relative to the handle head 51 to abut the highest points 612 of the second beveled surfaces 61 of the bell 60 against the highest points 522 of the respective first beveled surfaces 52 of the handle head 51. At this time, the bell 60 is pushed outward relative to the handle head 51 to carry the positioning shaft 42 along the axis of the axial hole 53 toward the outside of the handle head 51, thereby disengaging the second positioning portion 424 of the positioning shaft 42 from the first positioning portion 322 of the claw 30, as shown in FIG. 9A. At this time, the elastic restoring component 44 is compressed by the flange 422 of the positioning shaft 42. Thus, subject to the pivot connection relationship between the claw 30 and the handle 50, the user can bias the claw 30 relative to the handle 50 to the desired operating angle at this time. After the claw 30 is adjusted to the desired operating angle, release the hand from the bell 60, enabling the positioning shaft 42 to be forced by the elastic potential energy of the elastic restoring component 44 to move along the axis of the axial hole 53 in direction toward the inside of the handle head 51. Further, after released the bell 60, rotate the bell 60 relative to the handle head 51 in the reversed direction during inward displacement of the bell 60 with the positioning shaft 42, forcing the second beveled surfaces 61 of the bell 60 into abutment against the respective first beveled surfaces 52 of the handle head 51 to the extent that the second positioning portion 424 of the positioning shaft 42 is engaged into another first positioning portion 322 of the claw 30 to lock the claw 30 to the handle head 51, as shown in FIG. 9B. When compared with the aforesaid first embodiment, the matching design of the first beveled surfaces 52 and the second beveled surfaces 61 facilitates the user in adjusting the angular position of the claw 30 with less effort.

Figure 10:
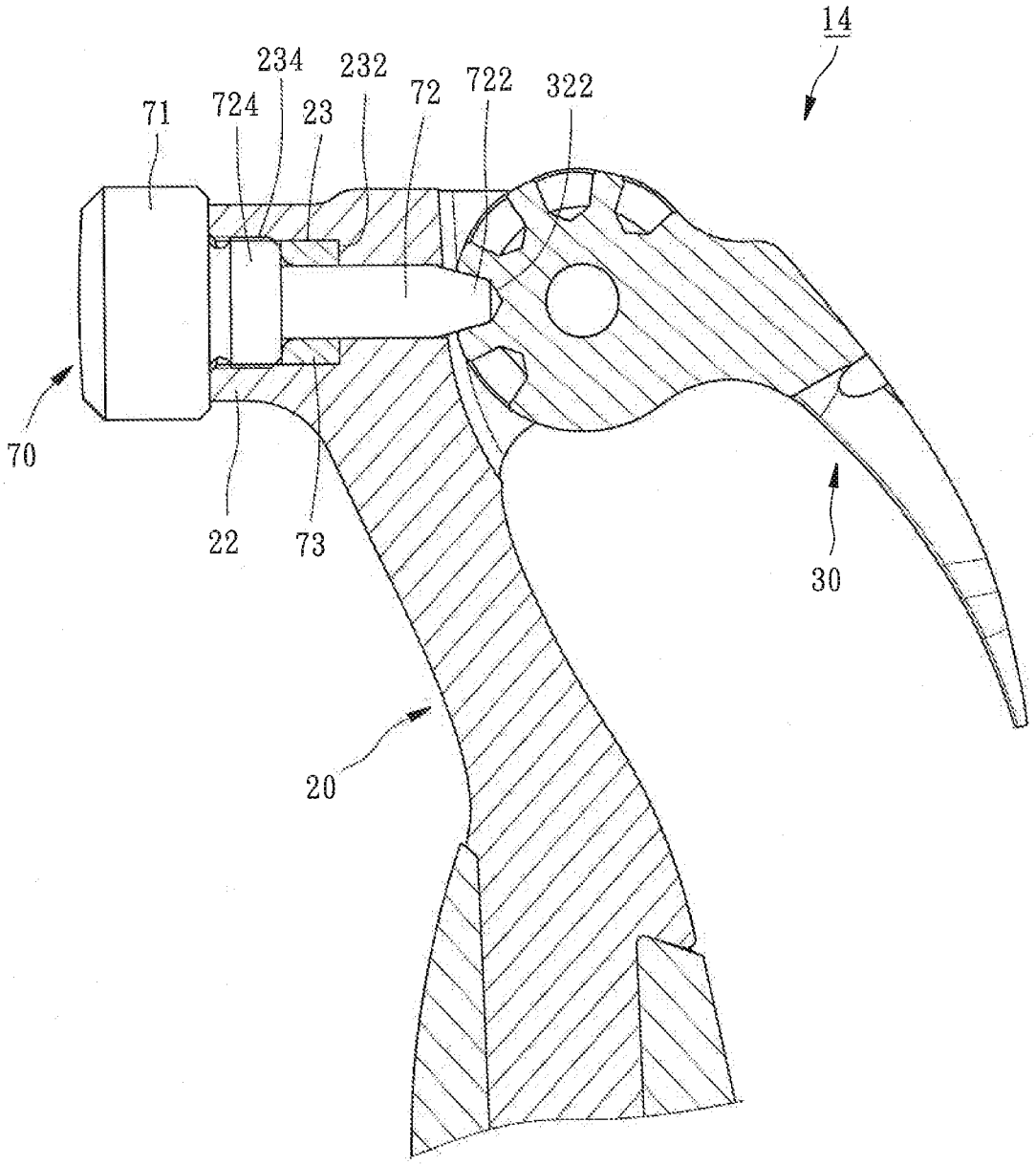
FIG. 10 is a sectional plain view of a claw hammer in accordance with a third embodiment of the present invention.

Referring to FIG. 10, a claw hammer 14 in accordance with a third embodiment of the present invention is shown. This third embodiment is substantially similar to the aforesaid first embodiment with the exception of the following features.

According to this third embodiment, the hammer head 70 comprises a bell 71, a positioning shaft 72, and a washer 73. The bell 71 is coupled to the front end of the handle head 22 of the handle 20. The positioning shaft 72 is inserted into the inside of the axial hole 23 of the handle 20 and connected with the bell 71, comprising a second positioning portion 722 adapted for selectively engaging into one first positioning portion 322 of the claw 30. The positioning shaft 72 further comprises an externally threaded segment 724. Further, the axial hole 23 of the handle 20 defines therein an internally threaded segment 234 adapted for threading onto the externally threaded segment 724 of the positioning shaft 72. The washer 73 is mounted around the positioning shaft 72 between the externally threaded segment 724 of the positioning shaft 72 and the stepped portion 232 in the axial hole 23 of the handle 20 to fill up the gap.

Figure 11A:
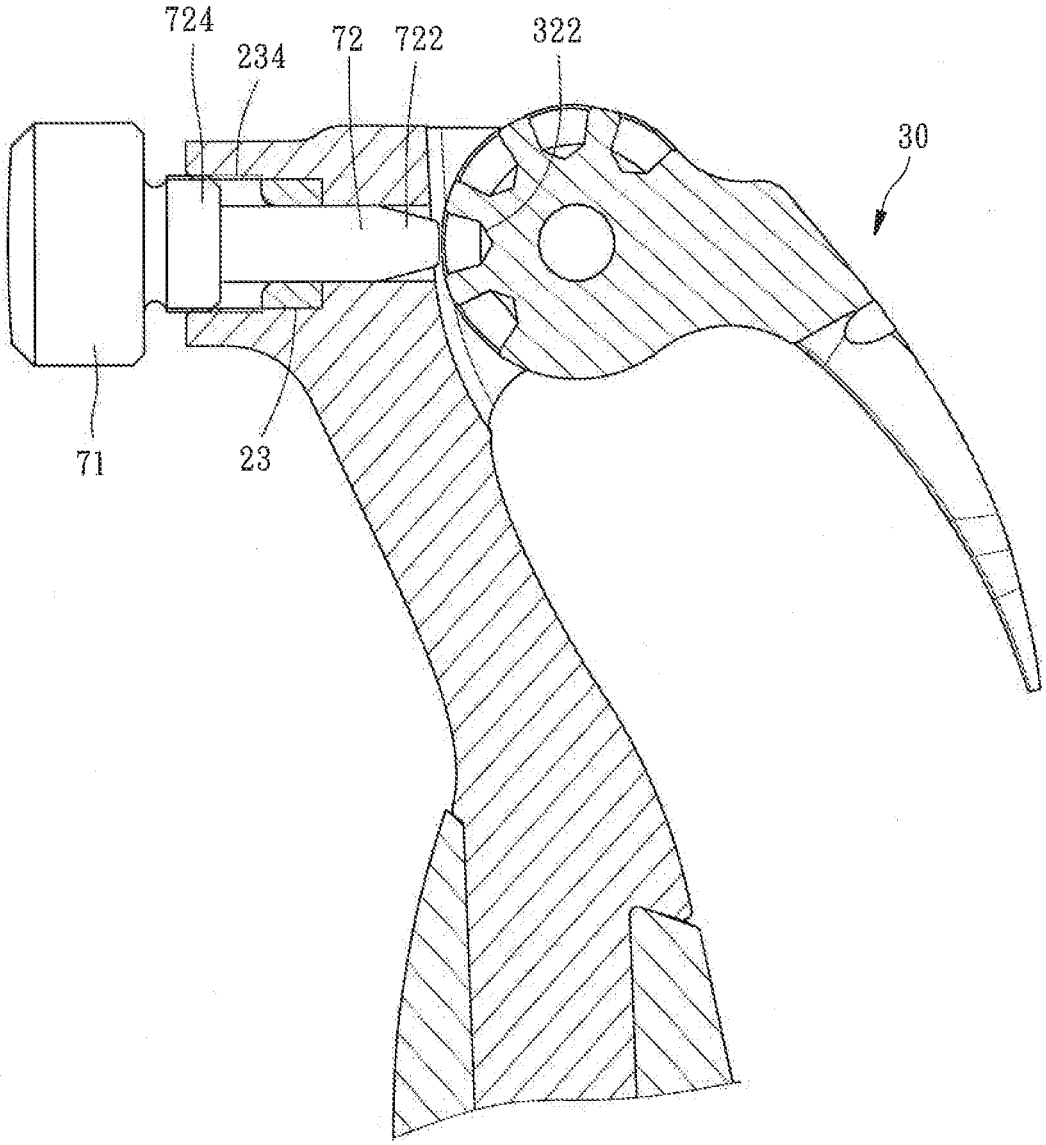
FIG. 11A and FIG. 11B are similar to FIG. 10, illustrating the adjustment of the angular position of the claw.
Figure 11B:
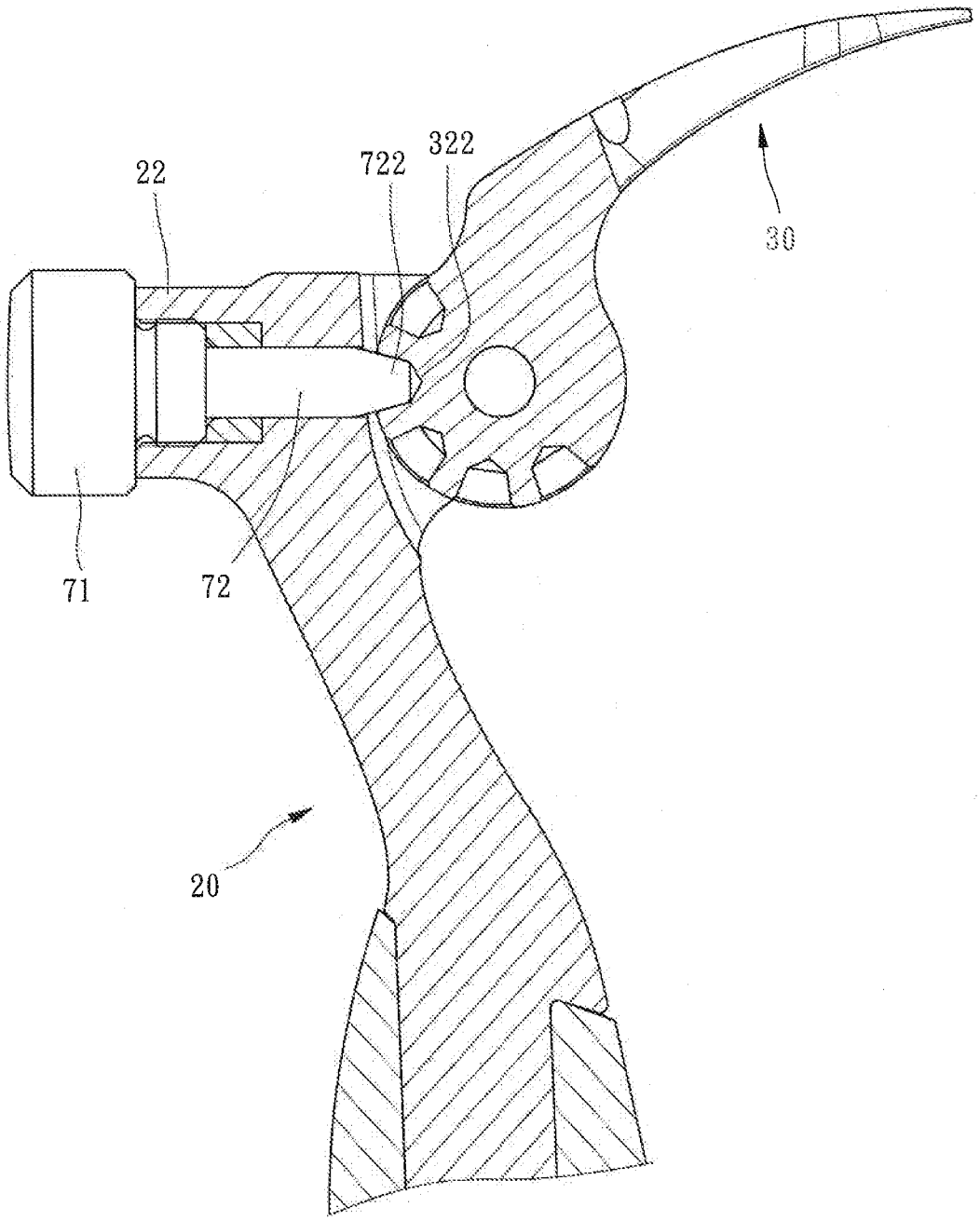

When going to adjust the angular position of the claw 30, as shown in FIG. 11A, loosen the bell 71 to gradually disengage the externally threaded segment 724 of the positioning shaft 72 from the internally threaded segment 234 of the axial hole 23, enabling the positioning shaft 72 to be moved outwardly along the axis of the axial hole 23 to disconnect the second positioning portion 722 of the positioning shaft 72 from the first positioning portion 322 of the claw 30, and then bias the claw 30 to the desired angle, and then fasten tight the bell 71 against after adjustment of the claw 30 to the desired angle, as shown in FIG. 11B. When fastening up the bell 71, the positioning shaft 72 is moved inwardly along the axis of the axial hole 23 to force the second positioning portion 722 of the positioning shaft 72 into engagement with another first positioning portion 322 of the claw 30, and thus the claw 30 is locked in the adjusted angular position. Thus, this third embodiment uses a screw joint to substitute for the aforesaid circlip 43 and elastic restoring component 44, enhancing the operating convenience and simplifying the structure.

Figure 12:
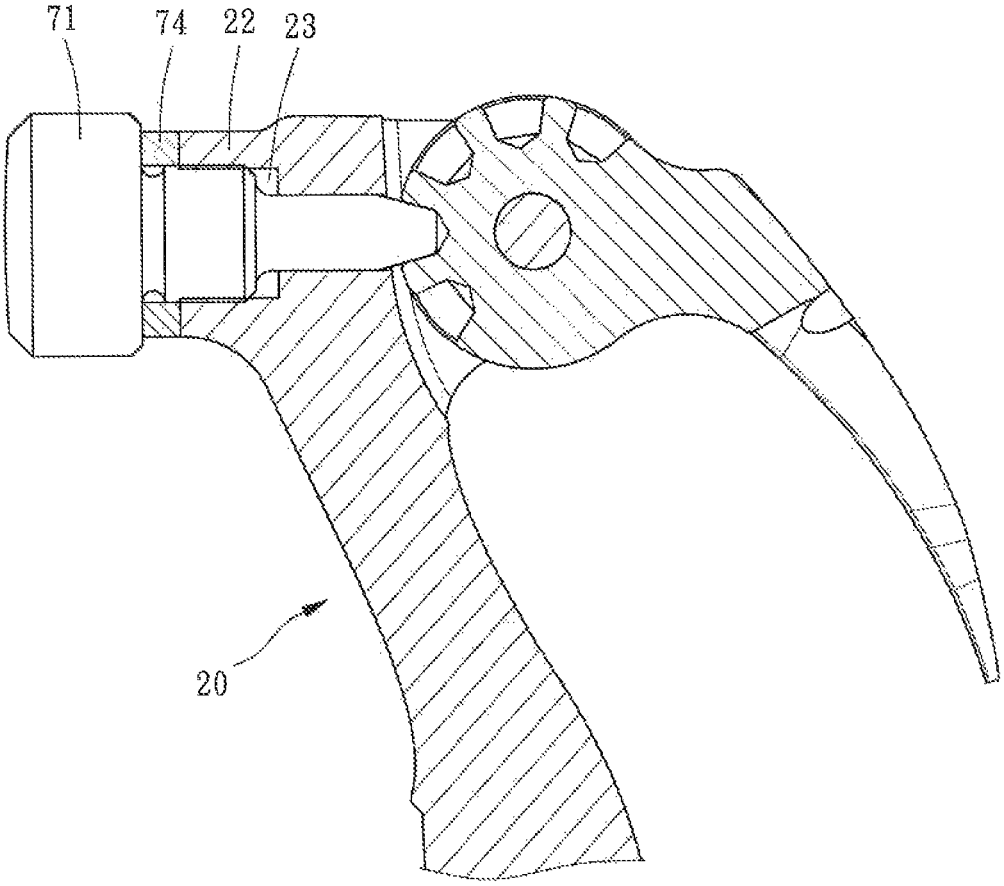
FIG. 12 is a sectional plain view of a claw hammer in accordance with a fourth embodiment of the present invention, illustrating a different washer mounting position.

Further, it is to be noted that different washer mounting designs can be selected used. For example, in FIG. 12, the washer 74 is mounted outside the axial hole 23 and disposed between the handle head 22 of the handle 20 and the bell 71 to fill up the gap between the handle head 22 of the handle 20 and the bell 71.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A claw hammer, comprising:

a handle comprising a handle body and a handle head fixedly mounted at a top end of said handle body;

a claw pivotally mounted at said handle head of said handle; and a hammer head mounted at said handle head and movable relative to said handle head between a locking position where said hammer head and said claw are locked together and an unlocking position where said claw is unlocked from said hammer head and rotatable relative to said handle, wherein said handle head of said handle comprises an axial hole; said claw comprises a pivot connection and a plurality of first positioning portions disposed around the periphery of said pivot connection; said hammer head comprises a positioning shaft axially movably mounted in said axial hole, said positioning shaft comprising a second positioning portion, said second positioning portion being selectively engaged into one of said first positioning portions of said claw to lock said claw to said handle head when said hammer head is moved to said locking position, said second positioning portion of said positioning shaft being disengaged from said first positioning portion of said claw when said hammer head is moved to said unlocking position, and said axial hole of said handle head of said handle defines a stepped portion; said positioning shaft comprises a flange stopped at said stepped portion in said axial hole of said handle head; said hammer head further comprises a circlip and an elastic restoring component, said circlip being attached to said positioning shaft and fixedly mounted in said axial hole, said elastic restoring component being sleeved onto said positioning shaft and stopped between said circlip and said flange of said positioning shaft.

2. The claw hammer as claimed in claim 1, wherein said handle head of said handle comprises a mounting slot disposed in communication with said axial hole; said pivot connection of said claw is movably accommodated in said mounting slot of said pivot connection and pivotally connected to said handle head of said handle by a pivot; said first positioning portions are arranged in a curved line around said pivot.

3. The claw hammer as claimed in claim 1, wherein said handle head of said handle comprises a first planar abutment surface portion located at a front end thereof adjacent to said axial hole; said hammer head comprises a bell connected to said positioning shaft, said bell comprising a locating hole located at a rear end thereof and a second planar abutment surface portion disposed adjacent to said locating hole and detachably abutted against said first planar abutment surface portion; said positioning shaft comprises a locating end fastened to said locating hole of said bell.

4. The claw hammer as claimed in claim 1, wherein said handle head of said handle comprises a first beveled surface located at the front end thereof around said axial hole; said hammer head comprises a bell connected to said positioning shaft, said bell comprising a locating hole and a second beveled surface located at a rear end thereof, said second beveled surface extending around said locating hole and abutted against said first beveled surface of said handle head, said second beveled surface sloping in a direction reversed to the sloping direction of said first beveled surface of said handle head; said positioning shaft comprises a locating end fastened to said locating hole of said bell.

5. The claw hammer as claimed in claim 1, wherein said handle head of said handle comprises a clamping protrusion; said claw comprises a nail-pulling portion, said nail-pulling portion defining with said clamping protrusion of said handle head a clamping gap therebetween.

* * * * *